US005997644A

United States Patent [19]

Zickell

[11] Patent Number: 5,997,644

[45] Date of Patent: Dec. 7, 1999

[54] MEDIA DEPOSITING SYSTEM AND METHOD

[75] Inventor: Thomas J. Zickell, Stratham, N.H.

[73] Assignee: Environmental Reprocessing, Inc., Brentwood, N.H.

[21] Appl. No.: 08/993,506

[22] Filed: Dec. 18, 1997

Related U.S. Application Data

[63] Continuation-in-part of application No. 08/572,125, Dec. 14, 1995, Pat. No. 5,814,369.

[51] Int. Cl.[6] ..... B05B 7/06

[52] U.S. Cl. ..... 118/310; 118/308

[58] Field of Search ..... 118/308, 311, 118/324, 313, 211, 216, 221, 244, 255, 258, 310; 425/130; 427/186, 180, 188; 222/129, 145.4, 166, 172

[56] References Cited

U.S. PATENT DOCUMENTS

| | | | |
|---|---|---|---|
| 1,574,835 | 3/1926 | Maclean | 118/311 |
| 2,037,822 | 4/1936 | Robert | 427/188 |
| 3,360,393 | 12/1967 | Rhorer | 427/188 |
| 3,548,781 | 12/1970 | Hornung | 118/5 |
| 3,730,397 | 5/1973 | Magnus | 222/254 |
| 3,908,591 | 9/1975 | Hall | 118/308 |
| 4,055,688 | 10/1977 | Caratsch | 427/195 |
| 4,295,445 | 10/1981 | Kopenhaver | 118/695 |
| 4,352,837 | 10/1982 | Kopenhaver | 427/187 |
| 4,417,544 | 11/1983 | Nishimura | 118/311 |
| 4,478,869 | 10/1984 | Brady et al. | 427/10 |
| 4,497,274 | 2/1985 | Focke | 118/221 |
| 4,900,589 | 2/1990 | Montgomery | 427/188 |
| 5,037,671 | 8/1991 | Karna et al. | 427/126.3 |
| 5,382,291 | 1/1995 | Olioso | 118/212 |
| 5,405,647 | 4/1995 | Grubka et al. | 427/188 |
| 5,554,393 | 9/1996 | Uchida et al. | 425/130 |
| 5,814,369 | 9/1998 | Bockh et al. | 427/188 |

*Primary Examiner*—Richard Crispino
*Assistant Examiner*—Calvin Padgett
*Attorney, Agent, or Firm*—Bourque and Associates, PA

[57] ABSTRACT

A system and method for depositing a pattern of media on a moving surface includes a media depositing apparatus that deposits media in a predefined pattern on the moving surface. A media applicator roll having a media receiving region, such as engraved or raised portions, receives the media from a media feeder as the media applicator roll rotates. A media retaining member maintains the media in contact with the media receiving region until the media reach a bottom region of the media applicator roll and are released from the media applicator roll in the predefined pattern onto the moving surface. The media depositing system also includes a multiple compartment media feeder that selects and selectively feeds one or more of multiple types of media or granules to the receiving region of the media applicator roll. The method for depositing a pattern of media includes synchronizing the speed of rotation of the media applicator roll with the speed of the moving sheet of material so that the media are precisely deposited as they are released from the media receiving region. The method also includes minimizing the distance that the media must drop from the applicator roll receiving region to the moving surface.

26 Claims, 5 Drawing Sheets

MEDIA DEPOSITING SYSTEM AND METHOD

CROSS REFERENCE TO RELATED APPLICATIONS

This application is a continuation-in-part of U.S. patent application Ser. No. 08/572,125 filed Dec. 14, 1995, entitled "MEDIA DEPOSITING SYSTEM AND METHOD", now U.S. Pat. No. 5,814,369.

FIELD OF THE INVENTION

This invention relates to a system and method for depositing a pattern of media and in particular, to a system and method for depositing different blends of granules in a predefined pattern on a continuously moving sheet to form a roofing material.

BACKGROUND OF THE INVENTION

A common method of manufacturing roofing materials involves depositing granules on a coated sheet of material, such as a webbed material that is coated with asphalt. A common roofing material is the roofing shingle which presents a well defined and pleasing pattern on a roof. Shingles are time consuming to install, however, and the seams present a potential source of water leaks. Although a continuous sheet of roofing material would be preferable, such a continuous sheet lacks the distinctive "shingle" pattern users have grown accustomed to.

Some attempts have been made at depositing granule patterns on a continuous sheet of material. The continuous sheet of material is unrolled, coated with a tacky material such as asphalt, and moved beneath a granule application device that drops granules onto the tacky coating covering the sheet. Existing granule application devices are limited in that they are not capable of depositing granules in a predefined pattern, such as a pattern simulating overlapping shingles. A sheet of shingle material with a pattern simulating overlapping shingles would be useful and would save considerable time in the roofing industry.

A typical granule application device uses a hopper and a roll or gate rotating beneath the hopper to allow the granules to fall onto the moving sheet of roofing material itself. However, such devices do not adequately control the falling of the granules onto the moving sheet of roofing material and do not allow the granules to be deposited in a predetermined and predefined pattern.

One such prior art granule application device is disclosed in U.S. Pat. No. 4,900,589 to Montgomery. This granule application device includes a series of granule applicators and a sheet that travels under the applicators for receiving the granules. Each applicator includes a roll and gate unit for depositing the granules by allowing the granules to just fall to the sheet. This device does not deposit granules in a predefined pattern on the sheet and does not control the dropping of the granules.

Another device is disclosed in U.S. Pat. No. 4,478,869 to Brady, et al. This device includes a series of hoppers for applying granules to a continuously moving strip. This device provides a means for sensing the amount of excess granules collected in a back fall hopper and for monitoring the rate of discharge of the granules to the back fall hopper. However, this device does not provide a system and method that controls the dropping of granules and deposits granules in a pattern on the continuously moving sheet.

Other granule application systems are overly complex and have been unable to simply and efficiently deposit a pattern of granules on a continuous sheet of shingle material. Such devices are disclosed in U.S. Pat. Nos. 4,295,445 and 4,352,837 issued to Kopenhaver. This type of apparatus and method for manufacturing roofing shingles is a long and complex process in which one stage includes applying a series of bands of coating asphalt with an inking wheel so that the granules will stick to the bands of asphalt in a pattern. Such a complex and time consuming process is expensive and unproductive.

Conventional granule application systems also require a large amount of space. In particular, when different granular blends, e.g. different types or colors of granules, are being deposited, the conventional granule application systems typically use a separate granule applicator for each type or color of granule. Each granule applicator takes up a significant amount of space which is often at a premium in most manufacturing plants, and the media to be coated with granules must be passed through successive granule applicators.

Accordingly, what is needed is a system and method for precisely depositing various combinations and different types of granules, particles, liquid, or any other type of media, in a predefined pattern on a continuously moving surface. The media depositing system and method should be simple and efficient so as to minimize the production costs and increase productivity. The system and method should control the dropping of the media to precisely deposit the media in a predefined pattern, for example, by controlling the speed and distance at which the media is dropped. A need also exists for a media depositing system that can deposit different types of media in the pattern without requiring a large amount of space for multiple applicators.

SUMMARY OF THE INVENTION

The present invention features a system for depositing multiple or different types of media, such as different granule blends, in a pattern on a moving surface, such as a moving sheet of material. The system comprises a media applicator device disposed above the moving surface, for depositing media on the moving surface in the pattern. The media applicator device includes a media receiving region corresponding to the pattern.

The system further comprises a multiple compartment media feeder disposed proximate the media receiving region of the media applicator device. The multiple compartment media feeder includes a plurality of compartments each compartment for containing a different type of media for selectively feeding each type of media from each compartment to the media receiving region of the media applicator device.

The preferred embodiment of the multiple compartment media feeder includes a media dispensing member having a slot disposed proximate the media receiving region of the media applicator device. The plurality of compartments are moveable with respect to the media dispensing member such that one of the multiple or different types of media is dispensed through the slot when the slot is aligned with the compartment containing that type of media. The media dispensing member preferably has an arcuate or curved cross-section and is stationary with respect to the plurality of compartments which pivot to selectively align each of the compartments with the slot in the media dispensing member.

The system further includes a positioning mechanism, coupled to the multiple compartment media feeder, for moving or pivoting the plurality of compartments with respect to the media dispensing member. The system also includes a stopping member, moveable between the slot of the media dispensing member and the receiving region of the media applicator device, for stopping flow of the media to the media receiving region.

The preferred embodiment of the media applicator device includes a media applicator roll, rotating above the moving surface, and a media retaining member, proximate at least a portion of the media applicator roll, for maintaining the media in the media receiving region as the media applicator roll rotates. The media applicator roll and media retaining member release the media on the moving surface. The multiple compartment media feeder is preferably disposed proximate a point on the media applicator roll between about 0 degrees and 90 degrees from a top point on the media applicator roll.

One embodiment of the media retaining member includes a media retaining belt proximate at least a portion of the media applicator roll and moveable with the applicator roll. The media retaining belt terminates at a point beneath the media applicator roll, for maintaining media in contact with the media receiving region of the media applicator roll until the media reach a bottom region of the media applicator roll.

The media receiving region preferably includes an engraved region in a surface of the media applicator roll, forming the pattern. Examples of the engraved region include a plurality of pockets or indentations and/or slots formed in the surface, for receiving the media and forming the pattern.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
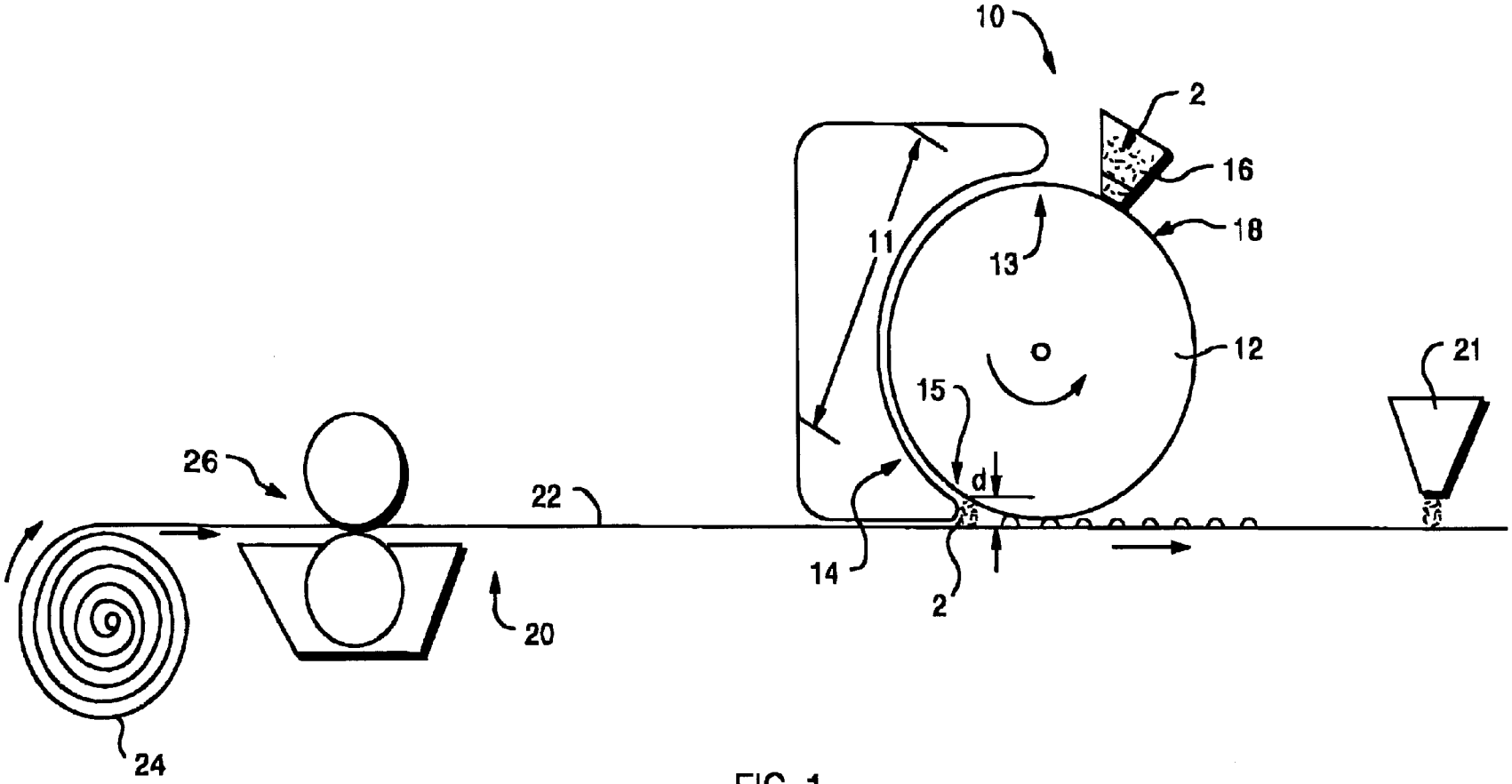
FIG. 1 is a side view of the system for depositing media in a predefined pattern according to the present invention.

A system for depositing media in a pattern according to the present invention includes an apparatus 10, FIG. 1, that deposits media 2, such as mineral and non-mineral media, sawdust, roofing granules, aluminum flakes, resin, ink, or any other particulates or material, in a predefined pattern on a surface 22 moving beneath the apparatus 10. The apparatus 10 for depositing media in a predefined pattern on the moving surface 22 includes a media applicator roll 12 having an media receiving region 18, such as an engraved or raised region, that receives the media in the predefined pattern. The media depositing apparatus 10 further includes a media retaining member 14, such as a belt or chute, proximate at least a portion 11 of the media receiving region 18 of the applicator roll 12 that retains the media 2 in the predefined pattern on the media receiving region 18 until the media 2 are deposited on the surface 22, as will be described in greater detail below.

An exemplary system and method for depositing media in a predefined pattern is a system and method for depositing media, such as granules or similar particles, in a pattern on the surface 22 of a sheet of material 20 to form a roofing material. One example of the pattern includes a shingle pattern that simulates the overlapping, double coverage of roofing shingles. The present invention also includes any pattern including, but not limited to, a slate pattern and a wood pattern.

In the exemplary system and method for depositing media on a sheet of material 20 to form a roofing product, the sheet of material 20 is coated along at least its top surface 22 with a tacky material, such as asphalt, so that the granules or other particles 2 deposited in a predefined pattern will fall to the surface 22 of the material 20. For example, the sheet of material 20 can be a web type material, such as fiber glass, polyester, paper, polyethylene, felt, polypropylene, metal or other similar materials commonly used for roofing, formed as a roll 24. The web material is coated along at least its top surface 22 with the tacky or asphaltic material according to any suitable method well known to those skilled in the art, for example, a conventional coating mechanism 26.

One way of moving the sheet of material 20 beneath the apparatus 10 is by a conventional web or paper conveying machine (not shown) known to those skilled in the art. The system according to the present invention can also include one or more additional media applicators 21, for example, to lightly coat granules or other media over the entire surface 22 after the predefined pattern of media has been deposited. The system according to the present invention also contemplates more than one media depositing apparatus 10 arranged in a series to deposit a predefined pattern on the moving sheet of material 20.

The present invention contemplates any type and size of mineral or non-mineral particle to be deposited including, but not limited to, roofing granules, sand, slag, aluminum flakes, resin, and sawdust. The present invention also contemplates liquid media, such as resin, ink or other substantially viscous liquids. In addition, the present invention contemplates various types of surfaces 22, with or without a coating, on which the various types of media 2 can be deposited.

In one embodiment, the apparatus 10 for depositing media in a predefined pattern on the moving surface 22 further includes a media feeder 16, such as a hopper, as will be described in greater detail below. As the media applicator roll 12 rotates, the media 2 in the media feeder 16 are fed to the media receiving region 18 of the applicator roll 12. The present invention contemplates any type of media feeder 16 including, but not limited to, a granule feeder, curtain feeder, drag box, gravity feeder, applicator roll, auger, pneumatic feeder, and other similar feeding devices.

In the preferred embodiment, the media retaining member 14 retains the media 2 within the media receiving region 18 along the portion 11 of the media receiving region 18 from a top region 13 to a bottom region 15 of the media applicator roll 12. Proximate the bottom region 15, the media 2 are released from the media receiving region 18 and dropped to the moving surface 22 in the predefined pattern. The distance d that the media 2 drop or fall from the media receiving region 18 of the media applicator roll 12 to the moving surface 22 is preferably minimized so that the media 2 are precisely deposited in the predefined pattern, as will be discussed in greater detail below.

One example of the media retaining member 14 includes a media retaining belt, such as endless belt made of a rubber or other similar material. Other examples of the media retaining member 14 include a chute or similar device generally contoured to match the exterior surface of application roll 12.

Figure 2:
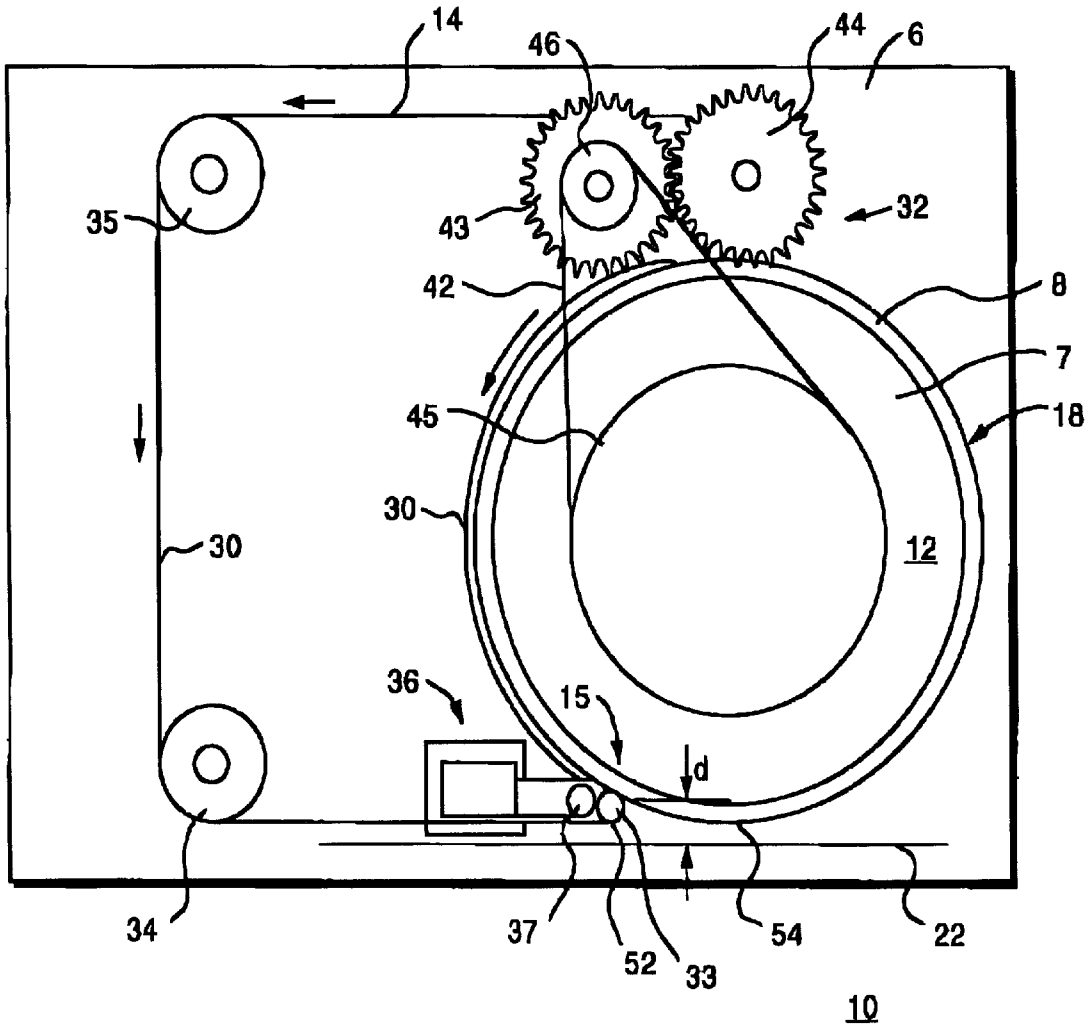
FIG. 2 is a side view of an apparatus for depositing media in a predefined pattern according to one embodiment of the present invention.

In a media depositing apparatus 10, FIG. 2, that uses a media retaining belt 30, the belt 30 runs around a plurality of rollers 32, 33, 34, 35. A first roller 32 holds the media retaining belt 30 proximate the media receiving region 18 of the media applicator roll 12 proximate the top region 13. A second roller 33 holds the media retaining belt 30 proximate the media receiving region 18 proximate the bottom region 15. The media retaining belt 30 moves around the rollers 32, 33, 34, 35 together with the media applicator roll 12 as the media applicator roll 12 rotates.

In the preferred embodiment, the granule applicator roll 12 is rotatably coupled to the first roller 32 so that the media retaining belt 30 moves along with the media applicator roll 12. One way of rotatably coupling media applicator roll 12 to first roller 32 is by a belt or chain drive mechanism including a belt or chain 42 rotatably engaged with the media applicator roll 12. The belt or chain 42 is rotatably engaged with a first gear 43 which engages a second gear 44 coupled to the first roller 32. Rotational movement is transmitted to the first roller 32 as the media applicator roll 12 rotates, e.g. by a motor, as will be described below. The first gear 43 then rotates second gear 44 and the first roller 32, thereby moving the media retaining belt 30 along with the media applicator roll 12.

One example of the chain drive mechanism includes a chain 42, such as a 60 pitch single roller chain approximately 48 in. in length. The chain is engaged with a sprocket 45 coupled to the media applicator roll 12, such as a 60 pitch/48 tooth sprocket having an outer diameter of approximately 11.893 in. and a pitch diameter of approximately 11.468. The chain 42 engages a sprocket 46 coupled to the first gear 43, such as a 60 pitch/11 tooth sprocket having an outer diameter of approximately 3.005 in. and pitch diameter of approximately 2.663 in. In this example, the first and second gears 43, 44 are spur gears having 10 pitch/48 teeth, an outer diameter of approximately 5 in. and a pitch diameter of approximately 4.8. A chain drive mechanism according to this example, will transmit movement from the media applicator roll 12 to the first roller 32 and the media retaining belt 30 so that the media retaining belt 30 moves along with the media applicator roll 12 at approximately the same speed.

The second roller 33 has a relatively small preferred diameter in the range of approximately 1 to 2 inches and is located proximate the bottom region 15 such that the distance d that the media 2 drop from the media applicator roll 12 to the surface 22 is minimized. The distance d can be minimized by positioning the second roller 33 so that the lowest point 52 of the second roller 33 lies substantially in the same horizontal plane as the lowest point 54 of the media applicator roll 12.

A cam follower mechanism 36 having one or more cam follower wheels 37 can be used with the second roller 33 if the second roller 33 has a relatively small diameter and needs additional support along its length.

In one example, the second roller 33 has a diameter of approximately 2.375 in. and is supported by two cam follower wheels 37 along the length of the second roller 33. Using this second roller 33 of 2.375 in. allows a distance d of approximately 2 in. or less between the point that the media drop from the media receiving region 18 and the surface 22.

In one example, the first roller 32, the third roller 34, and the fourth roller 35 have an outer diameter of approximately 4 in. and are spaced from one another at approximately 18.5 in. center-to-center. In this example, the media retaining belt 30 is an endless belt of approximately 90 in. in length, and the media applicator roll 12 has a diameter of approximately 18.382 in. The present invention, however, contemplates different numbers of rollers and various dimensions for the rollers, belts, and applicator roll.

The preferred embodiment of the media applicator roll 12 includes a substantially cylindrical outer sleeve 8 having the media receiving region 18 and secured around an internal support 7. The internal support 7 is preferably made of a rigid material, such as metal, and the sleeve 8 is preferably made of rubber or a similar material but the present invention contemplates other suitable materials such as plastic and metal. The sleeve 8, in one embodiment, can be removably secured to the internal support 7 using bolts, screws or the like. A plurality of sleeves 8 having media receiving regions 18 of various predefined patterns can be interchanged to easily and quickly vary the predefined patterns deposited on the surface 22.

The media depositing apparatus 10 further includes support members 6, such as support plates, for rotatably supporting the media applicator roll 12, the rollers 32, 33, 34, 35, and the first and second gears 43, 44 and for supporting cam follower mechanism 36 having cam follower wheels 37.

Figure 3:
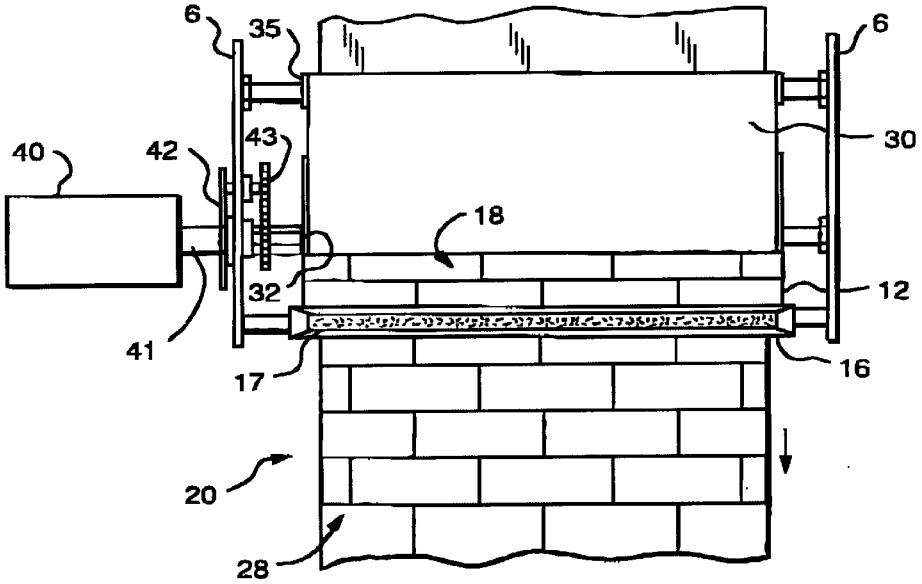
FIG. 3 is a top view of a system for depositing media in a predefined pattern including a moving surface having media deposited thereon in a predefined pattern according to one embodiment of the present invention.

A motor 40, FIG. 3, is coupled to a shaft 41 extending from the media applicator roll 12 for rotating the media applicator roll 12. Preferably the motor 40 is any type capable of driving a chain from a sprocket, e.g. a 3 to 5 h.p. motor. The applicator roll 12 may have its own drive system (motor, belt, gears, etc.) or may be driven from another source, as is well known in the art.

The media retaining belt 30 is approximately the same width of the media applicator roll 12. In one example, the media retaining belt 30 is approximately 42 in. wide and the media applicator roll 12 is approximately 43 in. wide. The width of the surface 22 also corresponds generally with the width of the applicator roll 12. In the example above, the width of the surface 22 is approximately 37 in. The present invention, however, contemplates media applicator rolls, media retaining belts, and surfaces of various sizes and dimensions.

One embodiment of the granule feeder 16 includes one or more hoppers extending at least part of the length of the media applicator roll 12. The hopper contains a supply of media 2, such as granules, that are fed to the entire length of the media receiving region 18, such as by gravity or by a mechanical feeding mechanism, as the media applicator roll 12 rotates. Preferably, the media feeder or hopper 16 includes a gasket or seal 17 around the opening of the media feeder or hopper 16 in contact with the media receiving region 18. The gasket or seal 17, typically made of a rubber or similar material, prevents media 2 from escaping as the media 2 are fed to the media receiving region 18. The media feeder or hopper 16 is supported between support members 6 and automatically replenished from a source of media(not shown).

Figure 4:
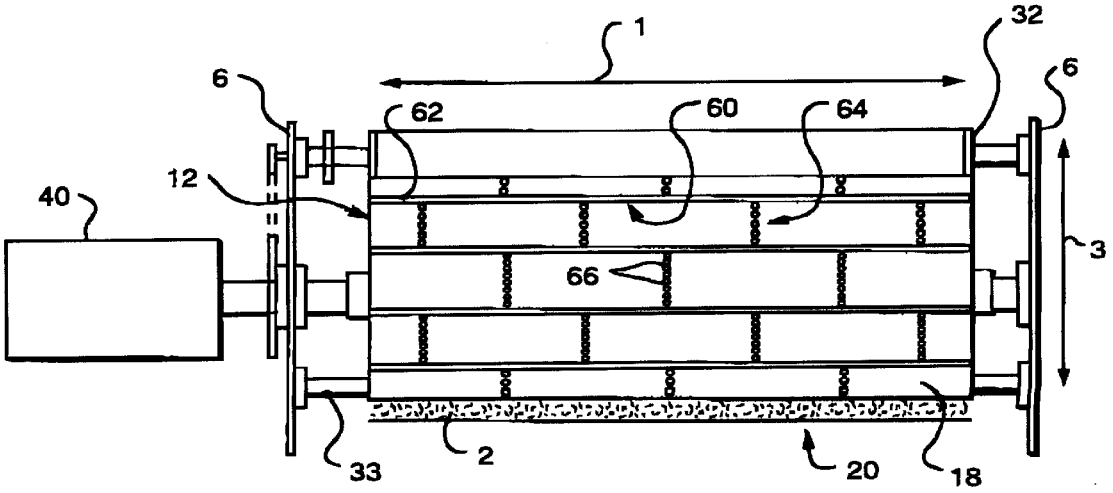
FIG. 4 is a side view of the media applicator roll including an media receiving region according to one embodiment of the present invention.

One embodiment of the media receiving region 18, FIG. 4, consists of a pattern of engraved portions 60, 64 that receive the media 2, such as granules, from the feeder 16 and hold the media as the media applicator roll 12 rotates. In one example, a first series of engraved portions 60 run substantially in an axial direction 1 along the media applicator roll 12 and are spaced circumferentially around the media applicator roll 12, e.g. at a predetermined distance of approximately 5.25 in. apart. A second series of engraved portions 64 run substantially in a circumferential direction 3 and are spaced axially on the media applicator roll 12, e.g. at a predetermined distance of approximately 11.75 in. apart.

The engraved portions 60, 64 arranged in this configuration deposit the media 2 in a simulated shingle pattern 28 (FIG. 3) on the moving sheet of material 20. The present invention contemplates various patterns of engraved portions 60, 64 to form various patterns other than a shingle pattern or to cover the entire surface 22.

The engraved portions 60 that run substantially in an axially direction 1 are preferably formed as slots 62. The engraved portions 64 running substantially in the circumferential direction 3 along the media applicator roll 12 are preferably formed as pockets 66.

Figure 5:
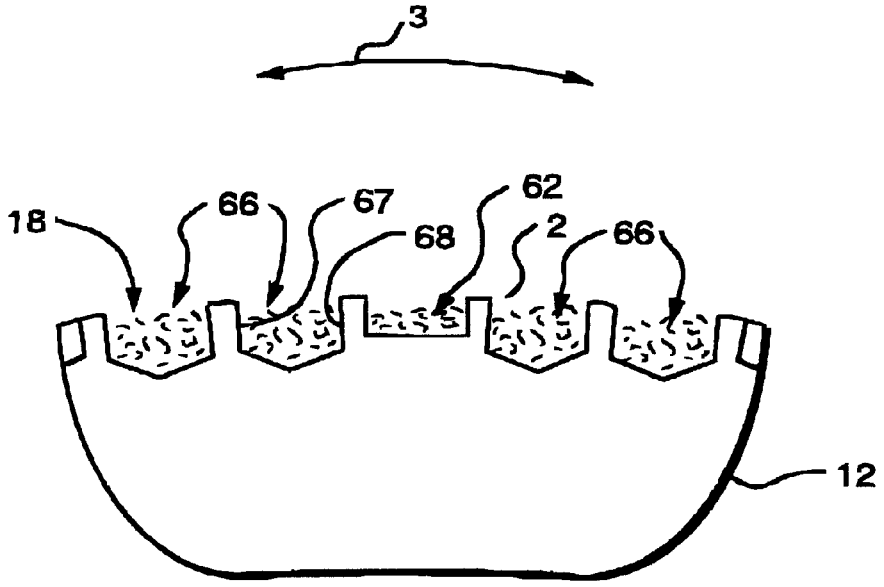
FIG. 5 is a cross-sectional view of an media receiving region having engraved portions on a media applicator roll according to one embodiment of the present invention.

A plurality of pockets 66, FIG. 5, are arranged substantially in the circumferential direction 3 along the media receiving region 18 of the media applicator roll 12 to form the engraved portions 64. Each pocket 66 includes side portions 67, 68 to prevent the media 2 contained within the pockets 66 from being displaced or sliding in the circumferential direction 3 as the media applicator roll 12 rotates. Thus, any engraved portion 64 that extends substantially in a circumference direction 3 is preferably formed as a series of pockets 66 so that the predefined pattern of the media is precisely maintained as the media applicator roll 12 rotates and deposits the media on the moving sheet of material. In addition to pockets, the present invention contemplates holes, grooves, or open areas that prevent the media from being displaced or sliding.

Figure 6:
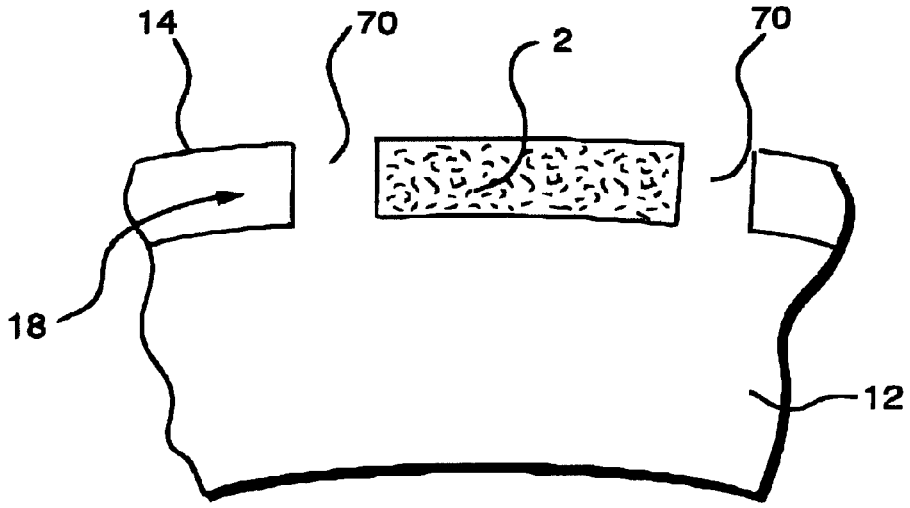
FIG. 6 is a cross-sectional view of an media receiving region having raised portions according to another embodiment of the present invention.

In another embodiment, the media receiving region 18, FIG. 6, of the media applicator roll 12 includes raised portions 70 that receive and hold media 2, such as granules, as the media applicator roll 12 rotates. The present invention also contemplates an media receiving region 18 having a combination of engraved and raised portions.

The method of depositing media in a predefined pattern on a moving surface includes rotating the media applicator roll at a predetermined speed and moving the surface at a predetermined speed beneath the media applicator roll and at a predetermined distance from the media applicator roll. In the preferred embodiment, the predetermined speed of rotation is synchronized to correspond with the predetermined speed of the moving surface 22. In other words, the linear velocity of the media applicator roll 12 at the point where the media are released from contact with the media receiving region 18 should substantially correspond with the linear velocity of the moving surface 22.

In one example, the surface 22 is moving at approximately 500 ft./min. and the speed of rotation of the media applicator roll 12 should be sufficient to provide a linear velocity of approximately 500 ft./min. at the point where the media are released. The present invention, however, contemplates moving the media applicator roll 12 and the moving surface 22 at different speeds.

Synchronizing the speed of rotation of the media applicator roll 12 and the speed of the moving surface 22 and minimizing the distance d that the media must drop from the media receiving region 18 to the moving surface allows the media to be dropped precisely in the predefined pattern. Such a controlled media drop prevents the media from shifting and prevents distortion of the predefined pattern of the media as the media are deposited on the surface 22.

Figure 7:
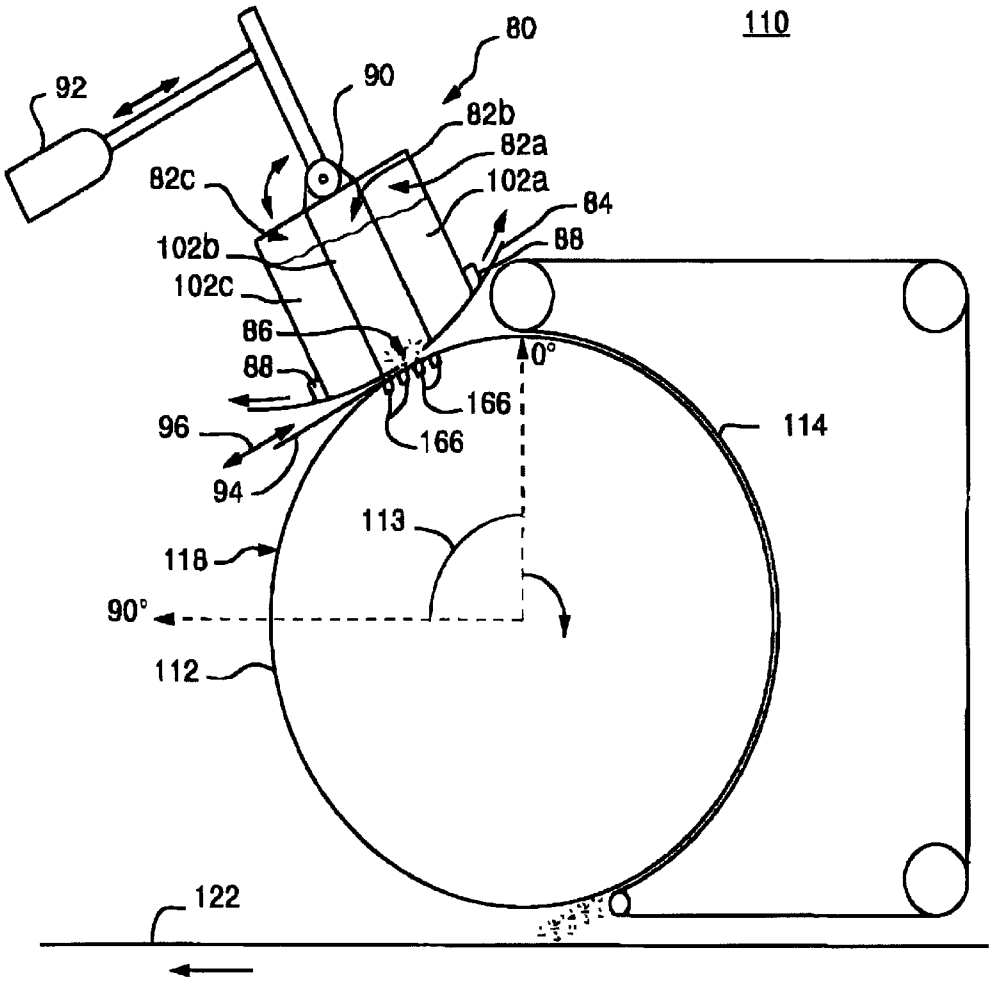
FIG. 7 is a side schematic view of the media depositing system having a multiple compartment media feeder according to a further embodiment of the present invention.

The present invention further includes a media depositing system 110, FIG. 7, having a multiple compartment media feeder 80 that feeds different types of media, such as different granule blends, to a media applicator roll 112 or other type of media applicator device. According to the exemplary embodiment, the multiple compartment media feeder 80 selectively feeds different types of granule blends, e.g. having different sizes or colors, to the media applicator roll 112, as described above, so that the different types of media are deposited in the predefined pattern on a moving sheet of material to form a shingle pattern with various textures or colors. The present invention, however, contemplates using the multiple compartment media feeder 80 with other types of media and with other types of applicator devices.

The multiple compartment media feeder 80 is positioned proximate the top half of the applicator roll 112, preferably at a point in the region 113 defined from about 0 degrees to 90 degrees from the top point of the applicator roll 112.

The multiple compartment media feeder 80 includes a plurality of compartments 82*a*–82*c* each containing one type or color of media or one type of granule blend 102*a*–102*c*. A media dispenser member 84 having one slot 86 is disposed beneath the compartments 82*a*–82*c* of the multiple compartment media feeder 80, for selectively feeding one of the multiple types of media 102*b* to the applicator roll 112. The plurality of compartments 82*a*–82*c* move relative to the media dispenser member 84 to selectively align one of the compartments 82*b* with the slot 86 so that the selected type of media 102*a*–102*c* is dispensed through the slot 86 and fed to the applicator roll 112. The slot 86 preferably extends the length of the compartments 82*a*–82*c* and is about ½ inches in width. One or more sealing gaskets or strips 88, preferably made of a plastic or soft metal strip, can be provided at the leading and trailing edges of the multiple compartment media feeder 80 and against the media dispenser member 84.

According to the preferred embodiment, the plurality of compartments 82*a*–82*c* are pivotable or moveable and the media dispenser member 84 is a rounded stationary plate against which the plurality of compartments 82*a*–82*c* slide while pivoting. The multiple compartment media feeder 80 is preferably mounted on a pivot 90, and a positioning mechanism 92, such as a servo or similar mechanism, as is well known in the art, is used to pivot or index the multiple compartment media feeder 80 about the pivot mount 90. The positioning mechanism 92 thereby precisely controls the alignment of a selected compartment 82*a*–82*c* containing a predetermined type of media 102*a*–102*c* with the slot 86. The positioning of each compartment 82*a*–82*c* into alignment with the slot 86 is preferably timed such that the pockets 166 or other engraved media receiving portion on the media receiving region 118 receive the granules. Controlling the speed of the movement of each compartment 82*a*–82*c* over the slot 86 in the dispenser member 84 also controls the amount of media or granules being fed to the applicator roll 112.

A stopping gate or member 94 can be selectively positioned between the slot 86 and the granule receiving region 118 of the applicator roll 112 to prevent the flow of media or granules through the slot 86, for example, when moving to another compartment or when the system is stopped. The stopping member 94 is preferably a plate that is slidably moved generally in the direction of arrows 96. The movement of the stopping member 94 can be coordinated with the positioning mechanism 92 and movement of the multiple compartment media feeder 80. In one example, the stopping gate 94 is moved with a servo or other positioning mechanism (not shown), and a controller can be used to control the positioning mechanisms and coordinate movement of the stopping gate 94 with that of the feeder 80, as is known to one of ordinary skill in the art. Alternatively, the stopping gate 94 and/or multiple compartment media feeder 80 can be operatively coupled to the mechanism that rotates the applicator roll, e.g. to provide a reciprocating movement as the applicator roll rotates.

Accordingly, the system and method for depositing the pattern of media according to the present invention allows different types of media to be deposited in a predefined pattern and provides for a controlled media drop so that the media are precisely deposited in that predefined pattern. The present invention also provides a relatively simple system and method for depositing media in a predefined pattern that is productive, cost efficient and space efficient.

Modifications and substitutions by one of ordinary skill in the art are considered to be within the scope of the present invention which is not to be limited except by the claims which follow.

What is claimed is:

1. A system for depositing multiple types of media in a pattern on a moving surface, said system comprising:

a media applicator device, disposed above said moving surface, for depositing media on said moving surface in said pattern, wherein said media applicator device includes at least one media receiving region corresponding to said pattern;

a multiple compartment media feeder, disposed proximate said media receiving region of said media applicator device, said multiple compartment media feeder including a plurality of compartments, each compartment for containing media; and a media dispensing member having a dispensing opening disposed proximate said media receiving region of said media applicator device, wherein said plurality of compartments are movable with respect to said media dispensing member, whereby said multiple compartment media feeder selectively feeds media from at least one of said plurality of compartments to said media receiving region of said media applicator device.

2. The system of claim 1 wherein said dispensing opening in said media dispensing member is a slot disposed proximate said media receiving region of said media applicator device, wherein said plurality of compartments are movable with respect to said media dispensing member such that one of said different types of media is dispensed through said slot when said slot is aligned with a respective one of said plurality of compartments in said multiple compartment media feeder.

3. The system of claim 2 wherein said media dispensing member has an arcuate cross-section and is stationary with respect to said plurality of compartments, and wherein said plurality of compartments are moveable to selectively align each of said plurality of compartments with said slot in said media dispensing member.

4. The system of claim 3 further including a positioning mechanism, coupled to said multiple compartment media feeder, for effecting movement of said plurality of compartments with respect to said media dispensing member.

5. The system of claim 2 further including a positioning mechanism, coupled to said multiple compartment media feeder, for positioning said plurality of compartments with respect to said media dispensing member.

6. The system of claim 2 further including a stopping member, movably positionable between said slot of said media dispensing member and said receiving region of said media applicator device, for stopping flow of said media to said media receiving region.

7. The system of claim 1 wherein said multiple types of media include different blends of granules.

8. The system of claim 1 wherein said multiple compartment media feeder is disposed proximate a portion of said media applicator roll that extends in a range of 0 degrees to 90 degrees from a top-most region on said media application roll.

9. A system for depositing multiple types of media in a pattern on a moving surface, said system comprising:

a media applicator roll, rotating above said moving surface, said media applicator roll including at least one media receiving region corresponding to said pattern to be deposited;

a media retaining member, proximate at least a portion of said media applicator roll, for maintaining said media in said at least one media receiving region of said media applicator roll as said media applicator roll rotates, wherein said media retaining member includes a media retaining belt proximate said at least a portion of said media applicator roll and movable with said media applicator roll; and a multiple compartment media feeder, disposed proximate said media receiving region of said media applicator roll, said multiple compartment media feeder including a plurality of compartments, each compartment for containing media, said multiple compartment media feeder further including a media dispensing member disposed proximate said media receiving region of said media applicator device, wherein said plurality of compartments are movable with respect to said media dispensing member, whereby said multiple compartment media feeder selectively feeds media from at least one of said plurality of compartments to said media receiving region of said media applicator roll.

10. The system of claim 9 wherein said multiple compartment media feeder is disposed at a point on said media applicator roll between 0 degrees and 90 degrees from a top point on said media applicator roll.

11. The system of claim 9 wherein said media retaining belt terminates at a point beneath said media applicator roll, for maintaining media in contact with said media receiving region of said media applicator roll until said media reach a bottom region of said media applicator roll.

12. The system of claim 9 wherein said media receiving region of said media applicator roll includes an engraved region in a surface of said media applicator roll, said engraved region for forming said pattern.

13. The system of claim 12 wherein said engraved region includes a plurality of pockets formed in said surface of said media applicator roll, for receiving said media.

14. The system of claim 13 wherein said engraved region further includes at least one slot formed in said surface of said media applicator roll, for receiving said media, and wherein said at least one slot and said plurality of pockets form said pattern.

15. The system of claim 13 wherein each of said plurality of pockets includes at least one side portion, for preventing said media contained within said each of said plurality of pockets from sliding out of said each of said plurality of pockets as said media applicator roll rotates.

16. The system of claim 9 wherein said media dispensing member has a slot disposed proximate said media receiving region of said media applicator roll, wherein said plurality of compartments are movable with respect to said media dispensing member such that one of said multiple types of media is dispensed through said slot when said slot is aligned with a respective one of said plurality of compartments in said multiple compartment media feeder.

17. The system of claim 16 wherein said media dispensing member has an arcuate cross-section and is stationary with respect to said plurality of compartments, and wherein said plurality of compartments are moveable to selectively align each of said plurality of compartments with said slot in said media dispensing member.

18. The system of claim 17 further including a positioning mechanism, coupled to said multiple compartment media feeder, for effecting movement of said plurality of compartments with respect to said media dispensing member.

19. The system of claim 17 further including a stopping member, movably positioned between said slot of said media dispensing member and said receiving region of said media applicator roll, for stopping flow of said media to said media receiving region.

20. The system of claim 19 wherein movement of said stopping member is responsive to movement of said multiple compartment media feeder.

21. The system of claim 20 wherein said multiple types of media include different blends of granules.

22. The system of claim 21 wherein said moving surface is disposed on a moving sheet of material, and wherein said different blends of granules are deposited on said moving surface of said moving sheet of material in said pattern.

23. The system of claim 9 wherein said media retaining member includes a plurality of rollers holding said media retaining belt proximate said media receiving region of said media applicator roll, said plurality of rollers being rotatably engaged with said media applicator roll such that said media retaining belt moves around said plurality of rollers as said media applicator roll rotates.

24. The system of claim 23 wherein one of said plurality of rollers holds said media retaining belt proximate a bottom region of said media receiving region of said media applicator roll, and whereby a position of said one of said plurality rollers determines a distance that said media drops from said media applicator roll to said moving surface.

25. The system of claim 24 wherein said one of said plurality of rollers is positioned substantially in the same horizontal plane as a lowest point of said media applicator roll.

26. The system of claim 24 wherein said one of said plurality of rollers holds said media retaining belt proximate a bottom region of said media receiving region such that said distance that said media drops from said media applicator roll to said moving surface is minimized.

* * * * *